US007434624B2

(12) United States Patent
Wilson

(10) Patent No.: US 7,434,624 B2
(45) Date of Patent: Oct. 14, 2008

(54) HYBRID TENSION-LEG RISER

(75) Inventor: W. Brett Wilson, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 448 days.

(21) Appl. No.: 10/627,006

(22) Filed: Jul. 25, 2003

(65) Prior Publication Data

US 2004/0129425 A1 Jul. 8, 2004

Related U.S. Application Data

(60) Provisional application No. 60/415,866, filed on Oct. 3, 2002.

(51) Int. Cl.
*E21B 29/12* (2006.01)
*E21B 33/35* (2006.01)

(52) U.S. Cl. ..... 166/368; 166/352; 405/224.4

(58) Field of Classification Search ..... 166/350, 166/351, 352, 359, 366, 367, 345; 405/171, 405/172, 158, 224.2, 224.4
See application file for complete search history.

(56) References Cited

U.S. PATENT DOCUMENTS

| | | | | |
|---|---|---|---|---|
| 3,983,706 A | | 10/1976 | Kalinowski | 61/98 |
| 3,996,755 A | | 12/1976 | Kalinowski | 61/86 |
| 4,371,037 A | * | 2/1983 | Arnaudeau | 166/366 |
| 4,400,110 A | | 8/1983 | Beynet et al. | 405/195 |
| 4,462,717 A | * | 7/1984 | Falcimaigne | 405/224.3 |
| 4,630,681 A | | 12/1986 | Iwamoto | 166/366 |
| 4,661,016 A | | 4/1987 | Baugh et al. | 405/169 |
| 4,669,916 A | | 6/1987 | White et al. | 405/224 |
| 4,673,313 A | | 6/1987 | Baugh et al. | 405/195 |
| 4,735,267 A | | 4/1988 | Stevens | 166/345 |
| 4,793,737 A | * | 12/1988 | Shotbolt | 405/169 |
| 5,007,482 A | | 4/1991 | Forsyth et al. | 166/345 |
| 5,040,607 A | | 8/1991 | Cordeiro et al. | 166/366 |
| 5,044,450 A | | 9/1991 | Aso et al. | 175/7 |
| 5,184,686 A | | 2/1993 | Gonzalez | 175/5 |
| 5,275,510 A | * | 1/1994 | de Baan et al. | 405/171 |
| 5,330,293 A | | 7/1994 | White et al. | 405/211 |
| 5,330,294 A | | 7/1994 | Guesnon | 405/224 |
| 5,354,151 A | | 10/1994 | Giannesini | 405/205 |
| 5,477,924 A | | 12/1995 | Pollack | 166/357 |

(Continued)

FOREIGN PATENT DOCUMENTS

EP 0 952 300 A1 10/1999

(Continued)

OTHER PUBLICATIONS

E. H. Phifer, et al., "Design and Installation of Auger Steel Catenary Risers", OTC 7620, 26th Annual Offshore Technology Conference, Houston, Texas, May 2-5, 1994, pp. 399-408.

(Continued)

*Primary Examiner*—Thomas A Beach

(57) ABSTRACT

This invention provides a production riser system that enables fluid communication in a deepwater drilling environment through the use of a variable buoyancy device supporting both a hybrid riser tower and an steel catenary riser (SCR) system. Fluid communication is enabled between a surface production facility or unloading buoy and local and remote subsea (or remote non-subsea) production and export systems.

19 Claims, 9 Drawing Sheets

U.S. PATENT DOCUMENTS

| | | | | |
|---|---|---|---|---|
| 5,480,264 | A | 1/1996 | Hunter | 405/195.1 |
| 5,505,560 | A | 4/1996 | Brown et al. | 405/195.1 |
| 5,533,574 | A | 7/1996 | Gonzalez | 166/358 |
| 5,549,164 | A * | 8/1996 | Blandford | 166/344 |
| 5,551,802 | A | 9/1996 | Wybro | 405/223 |
| 5,639,187 | A | 6/1997 | Mungall et al. | 405/195.1 |
| 5,647,443 | A | 7/1997 | Broeder | 175/5 |
| 5,706,897 | A | 1/1998 | Horton, III | 166/359 |
| 5,722,492 | A | 3/1998 | Finn | 166/367 |
| 5,727,640 | A | 3/1998 | Gleditsch | 175/7 |
| 5,758,990 | A | 6/1998 | Davies et al. | 405/242.2 |
| 5,762,149 | A | 6/1998 | Donovan et al. | 175/40 |
| 5,775,845 | A | 7/1998 | Wybro | 405/195 |
| 5,855,178 | A | 1/1999 | Treu et al. | 114/230 |
| 6,035,938 | A | 3/2000 | Watkins | 166/345 |
| 6,053,252 | A | 4/2000 | Edwards | 166/348 |
| 6,062,769 | A | 5/2000 | Cunningham | 405/195.1 |
| 6,082,391 | A * | 7/2000 | Thiebaud et al. | 137/236.1 |
| 6,109,989 | A | 8/2000 | Kelm et al. | 441/4 |
| 6,142,236 | A | 11/2000 | Brammer et al. | 166/358 |
| 6,146,052 | A | 11/2000 | Jacobsen et al. | 405/169 |
| 6,173,782 | B1 | 1/2001 | Watkins | 166/367 |
| 6,461,083 | B1 * | 10/2002 | Pionetti et al. | 405/224.2 |
| 6,472,614 | B1 * | 10/2002 | Dupont et al. | 174/70 S |
| 6,595,725 | B1 * | 7/2003 | Shotbolt | 405/224.2 |
| 6,854,930 | B2 * | 2/2005 | Pionetti | 405/172 |
| 7,100,694 | B2 * | 9/2006 | Legras et al. | 166/350 |
| 2006/0000615 | A1 * | 1/2006 | Choi | 166/352 |

FOREIGN PATENT DOCUMENTS

| | | | |
|---|---|---|---|
| EP | 0 952 301 | A1 | 10/1999 |
| GB | 2 341 875 | A | 3/2000 |
| GB | 2 351 301 | A | 12/2000 |
| GB | 2 354 219 | A | 3/2001 |
| SU | 1 724 895 | A1 | 3/1990 |
| WO | WO 88/00273 | | 1/1988 |
| WO | WO 95/07405 | | 3/1995 |
| WO | WO 95/28316 | | 10/1995 |
| WO | WO 96/21792 | | 7/1996 |
| WO | WO 97/42393 | | 11/1997 |
| WO | WO 99/50526 | | 10/1999 |
| WO | WO 00/03112 | | 1/2000 |
| WO | WO 00/05129 | | 2/2000 |

OTHER PUBLICATIONS

R. Uittenbogaard and J. Pijfers, "Integrated Asymmetric Mooring and Hybrid Riser System for Turret Moored Vessels in Deep Water", OTC 8441, 1997 Offshore Technology Conference, Houston, Texas, May 5-8, 1997, pp. 67-78.

D.C. McLaughlin and J.R. Padilla, "TLP Riser System Selection Considerations", American Society of Mechanical Engineers, Mar. 1987, V. 1, pp. 21-25.

P.W. Marshall, "Offshore Concepts for 3000-FT Water Depth, Gulf of Mexico", University of Newcastle Upon Tyne, 1993, vol. 1-Sec III-5, pp. 1-17.

R.J. Myers and J.H. Delgado, "Jolliet TLWP Well Systems", OTC V. 6401, May 1990, pp. 509-515.

Research Disclosure 29251, Aug. 1988, "Floating Wellhead/Production System".

*Design of Risers for Floating Production Systems* (*FPSs*) *and Tension-Leg Platforms* (*TLPs*, American Petroleum Institute, Recommended Practice 2RD, First Edition, Jun. 1998, pp. 1-163.

Witz, Joel A. et al., "Offshore LNG transfer—a new flexible cryogenic hose for dynamic service", Offshore Technology Conference, OTC 16270, Houston, Texas, May 3-6, 2004, pp. 1.15.

Hatton, Stephen A. , "Update on the Design of Steel Catenary Riser Systems", 2H Offshore Engineering Ltd., Deep and Ultra Deep Water Offshore Technology, Society of Underwater Technology, University of Newcastle, Mar. 25-26, 1999, pp. 1-12.

"Glossary", www.technip.com, printed Jan. 23, 2006, pp. 1-3.

"SCR design and analysis", www.2hoffshore.com, printed Jan. 23, 2006, pp. 1-2.

"Red Hawk, Gulf of Mexico, USA", Kerr-McGee, www.offshore-technology.com, printed Jan. 23, 2006, pp. 1-3.

"Seafloor Interaction with Steel Catenary Risers", Summary Plan 2004-2005 OTRC Project,www.otrc.tamu.edu, Dec. 2004-Jun. 2005, pp. 1-5.

"MCS Engineering Services Steel Catenary Riser", MCS Advanced Engineering Solutions, www.mcs.com, printed Jan. 23, 2006, p. 1.

"Case Study: Petrobras: Steel Catenary Riser FPS P-XVIII, Marlim Field", www.mcs.com, printed Jan. 23, 2006, pp. 1-3.

"Case Study: ChevronTexaco Typhoon", www.mcs.com, printed Jan. 23, 2006, pp. 1-3.

* cited by examiner

HYBRID TENSION-LEG RISER

REFERENCE TO RELATED APPLICATION

This application claims the benefit of U.S. Provisional Patent Application No. 60/415,866 filed Oct. 3, 2002.

FIELD OF THE INVENTION

This invention relates generally to the field of offshore petroleum operations, in particular, to a deepwater riser system intended for use in conjunction with a surface production facility. Specifically, the invention relates to a fluid transfer system for use in offshore hydrocarbon producing operations, which makes use of a self-standing hybrid production riser system as the supporting tension-leg mooring for one or more steel-catenary risers (SCRs), thus allowing both local and remote subsea production and export in a single system.

BACKGROUND OF THE INVENTION

Deepwater hydrocarbon production requires that significant obstacles be overcome, especially in the area of transfer of the various produced fluids. There are several types of flowlines or "risers" which can be used to enable this fluid transfer. For drilling and production purposes, the offshore body of water can be thought of as having two zones whose characteristics control which type of risers are practical therein. The wave zone, within approximately 100 meters of the surface, is characterized by the continuous motion and substantial forces which vessels and risers passing through the zone experience, due to the effects of near surface conditions such as wind, tides, and currents. These constant motions and forces exert fatigue-inducing stresses upon risers that traverse the wave zone, especially rigid risers. Therefore, flexible risers are best suited for use within the wave zone. In the deepwater zone, approximately 300 meters from the surface and deeper, the constant motions characteristic of the wave zone are substantially reduced; instead this zone is characterized by significant hydrostatic pressure which risers therein must withstand.

There have been several different riser systems proposed for use in deepwater hydrocarbon production. Some of these systems attempt to use a single type of riser, and others combine different riser types to enable fluid communication throughout both the wave and deepwater zones. Each of these methods has shortcomings which are overcome by the present invention.

Two methods have been proposed which were designed to overcome the difficulties of deepwater production while using a single type of riser. For example, one system involves the use of a flexible riser system from the production pipelines or subsea manifold on the marine bottom to the floating facilities. The major limitation of this method is that in order to withstand the hydrostatic pressure and high tensile loads present in the deepwater zone, these flexible risers are limited to relatively small interior diameters.

Another deepwater production method, that also teaches the use of a riser system with a single riser type, involves the use of steel catenary risers (SCRs). In this method a steel pipeline is laid along the sea floor and curved gently upward in a catenary path through the wave zone and connected directly to the floating vessel on the surface. The disadvantages inherent in this method are that: 1) the weight of such a steel catenary riser system must be borne by the floating vessel; 2) the steel catenary risers must be thickened to withstand the effects of the wave zone {which results in even more weight}; 3) the steel catenary risers are still subject to fatigue caused by the near surface effects, which could necessitate large-scale repairs which would be very difficult and expensive because of the depths at which they must be performed.

Deepwater hydrocarbon production therefore lends itself readily to a riser system employing two different types of risers, one set of risers designed to withstand the hydrostatic pressures of the deepwater zone and the other set of risers designed to withstand the constant and varying forces and motions of the wave zone. Two methods have been proposed which were designed to overcome the difficulties of deepwater production with riser systems that employ two different types of risers. The first such method, referred to as a hybrid riser tower, consists of a rigid section which extends vertically from the sea floor to a fixed position below the wave zone and a flexible section which is comprised of flexible pipe flowlines ("jumpers") that extend from the top of the rigid section, through the wave zone, to a floating vessel on the surface. A submerged buoy is typically used to maintain the rigid section of the hybrid riser tower in a substantially vertical position.

The other two-type riser system consists of steel catenary risers and flexible pipe jumpers used to enable fluid communication between the sea floor and the surface of a body of water. In this method, a submerged buoy is used to support the upper end of the SCR(s) at a location substantially below the wave zone. Flexible pipe jumpers extend from the top of the rigid (SCR) section, through the wave zone, to a floating vessel on the surface.

By using risers designed to withstand the characteristics of the two zones encountered in deepwater hydrocarbon production, both of these two-type riser systems are improvements over the single type riser systems discussed above. There remains, however, a need for a riser system that allows both local and remote fluid communication in deepwater applications.

BRIEF SUMMARY OF THE INVENTION

The present invention provides a fluid transfer system for use in offshore hydrocarbon producing operations comprising: a hybrid riser tower that extends upwardly from the sea floor to a location substantially below the wave zone of the body of water; a variable buoyancy device, to which the upper end of the hybrid riser tower is attached, capable of maintaining the hybrid riser tower in a substantially vertical orientation; one or more steel catenary risers extending upwardly from the sea floor and attached at their upper ends to the variable buoyancy device; and one or more flexible pipe jumpers extending from the variable buoyancy device to a surface production facility such that fluid flow is enabled between the flexible pipe jumpers and the hybrid riser tower and the steel catenary riser.

In another embodiment a process is provided for transferring fluids in offshore hydrocarbon producing operations, comprising the steps of: installation of a hybrid riser tower, including attaching a variable buoyancy device to the upper end of the hybrid riser tower, where the buoyancy of the variable buoyancy device is first reduced so that its net buoyancy does not exceed the design tension limit of the hybrid riser tower; installation of one or more steel catenary risers extending upwardly from the sea floor and attached at their upper ends to the variable buoyancy device, where the buoyancy of the variable buoyancy device is increased in order to support the steel catenary risers, while keeping the net buoyancy below the design tension limit of the hybrid riser tower; and attaching the lower ends of a plurality of flexible pipe jumpers to the variable buoyancy device and the upper ends to a surface production facility in such a manner as to allow fluid flow between the risers and the surface production facility.

BRIEF DESCRIPTION OF THE SEVERAL VIEWS OF THE DRAWINGS

The present invention and its advantages will be better understood by referring to the following detailed description and the attached drawings in which.

DETAILED DESCRIPTION OF THE INVENTION

In the following detailed description, the invention will be described in connection with its preferred embodiments. However, to the extent that the following description is specific to a particular embodiment or a particular use of the invention, this is intended to be illustrative only. Accordingly, the invention is not limited to the specific embodiments described below, but rather, the invention includes all alternatives, modifications, and equivalents falling within the true scope of the invention, as defined by the appended claims.

The invention comprises a method and an apparatus for enabling local and remote fluid communication in an offshore deepwater environment. The invention involves the use of a variable buoyancy device to support both a hybrid riser tower system and a steel catenary riser (SCR) system. In other words, the buoyancy element of the hybrid riser tower system also serves as the underwater termination location and the support for the upper end of the SCR(s). Due to the fact that the SCR(s) require buoyancy support on the order of ten times greater than that required for a typical hybrid riser tower, the buoyancy device must have a much greater maximum buoyancy. Therefore, it is necessary to reduce the buoyancy of the buoyancy device during installation of the hybrid riser tower to avoid exceeding the design tension limit of the hybrid riser tower. Then, the buoyancy of the buoyancy device must be increased as the SCR(s) are installed, in order to provide the necessary support. Flexible pipe jumpers are then installed to enable fluid communication between the surface production facility and the upper terminations of both the hybrid riser tower and the SCR(s). Although the surface production facility in each of the examples that follow is a floating production vessel, the flexible pipe jumpers can also terminate at moored surface facilities or at an unloading buoy. In addition, the buoyancy device may support mid-depth transfer lines to or from another production or unloading facility.

Figure 1:
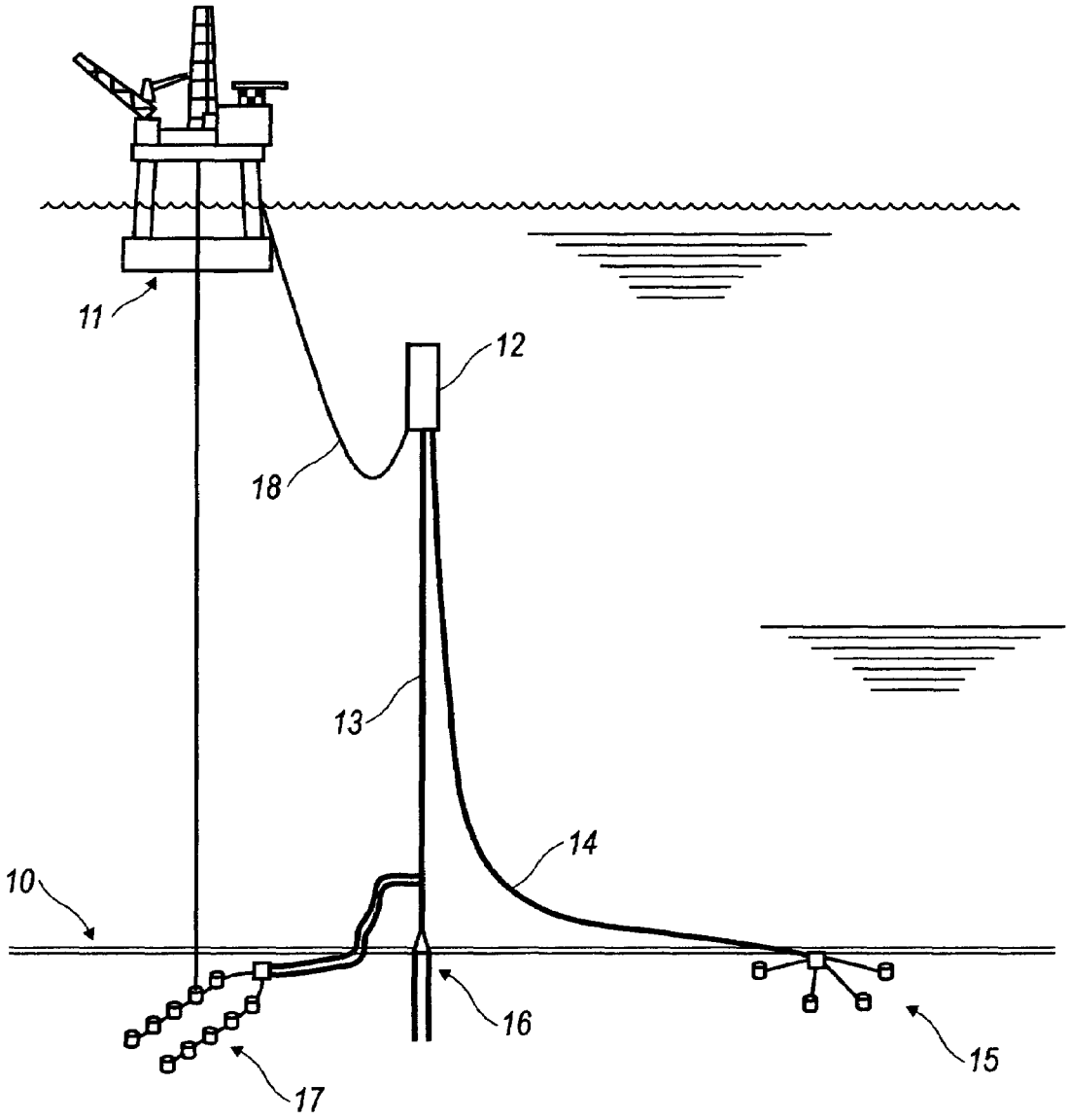
FIG. 1 is an elevation view of an embodiment of the invention where the variable buoyancy device supports a hybrid riser tower and steel catenary risers.

FIG. 1 illustrates a fluid transfer system allowing fluid communication between a surface production facility 11 and both a local production zone 17 and a remote production zone 15. A variable buoyancy device 12 supports both a hybrid riser tower 13 and a steel catenary riser (SCR) system 14. Flexible pipe jumpers 18 are connected to the variable buoyancy device 12 and to the surface production facility 11. The hybrid riser tower 13 is secured through a foundation or mooring 16 to the sea floor 10 and is connected to local production zone 17 and to variable buoyancy device 12. Steel catenary riser(s) 14 extend from a remote production zone 15 to the variable buoyancy device 12. The flexible pipe jumpers 18 transfer fluids between the hybrid riser tower 13 and SCR 14 terminations at the variable buoyancy device 12 and the surface production facility 11.

Figure 2:
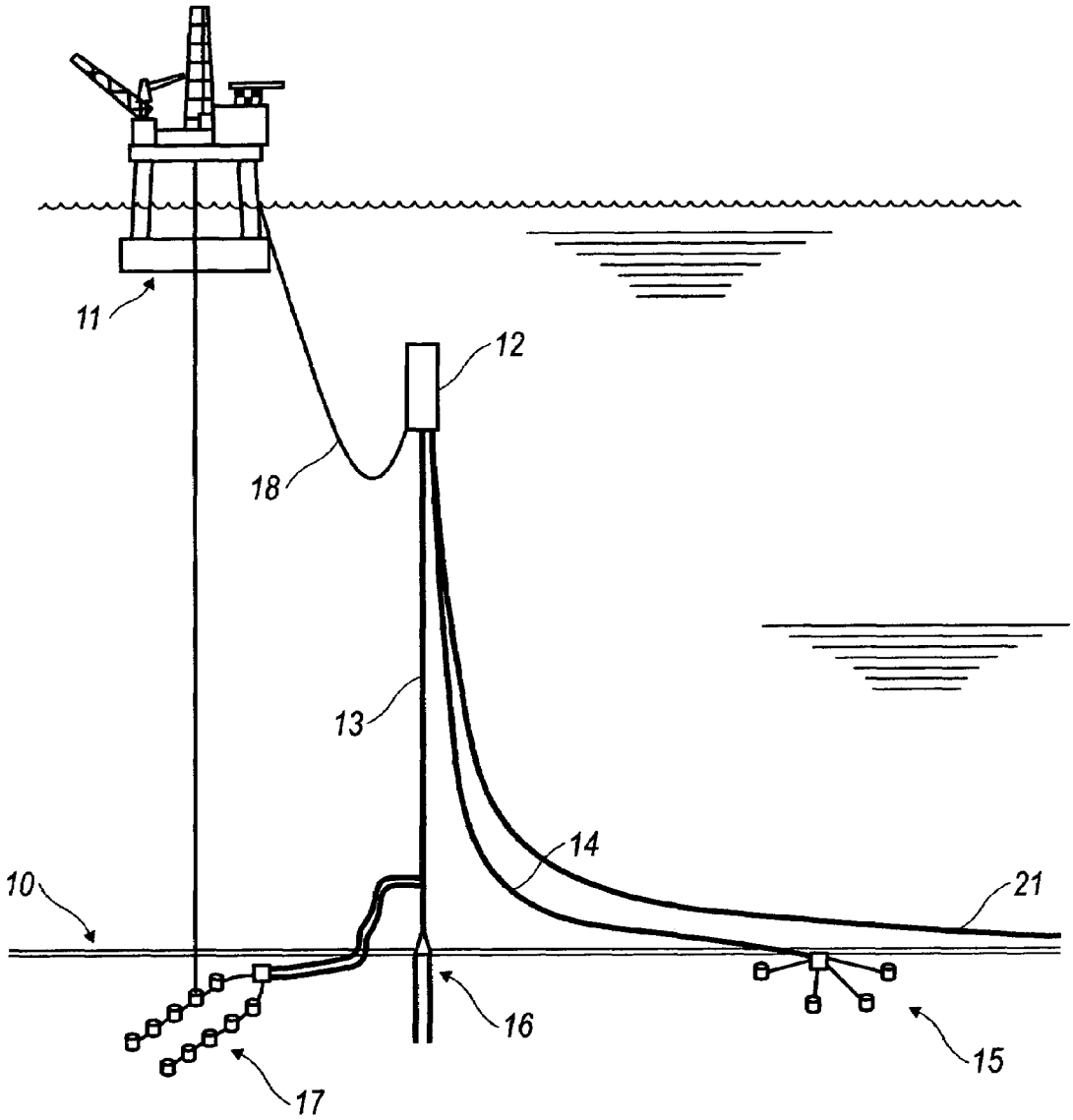
FIG. 2 is an elevation view of another embodiment of the invention where the variable buoyancy device also supports steel catenary risers dedicated to importing and exporting fluids to remote locations.

FIG. 2 illustrates another embodiment of this invention useful for enabling fluid export to remote locations, including export to onshore facilities. The components of this embodiment are the same as in the embodiment illustrated in FIG. 1 except that in this embodiment, a steel catenary riser(s) 21 is attached to and supported by variable buoyancy device 12 such that the other end of the riser terminates at a remote export location. Flexible pipe jumpers 18 transfer fluids between the surface production facility 11 and the variable buoyancy device 12, so as to enable fluid communication between the surface production facility 11 and the remote export location.

Figure 3:
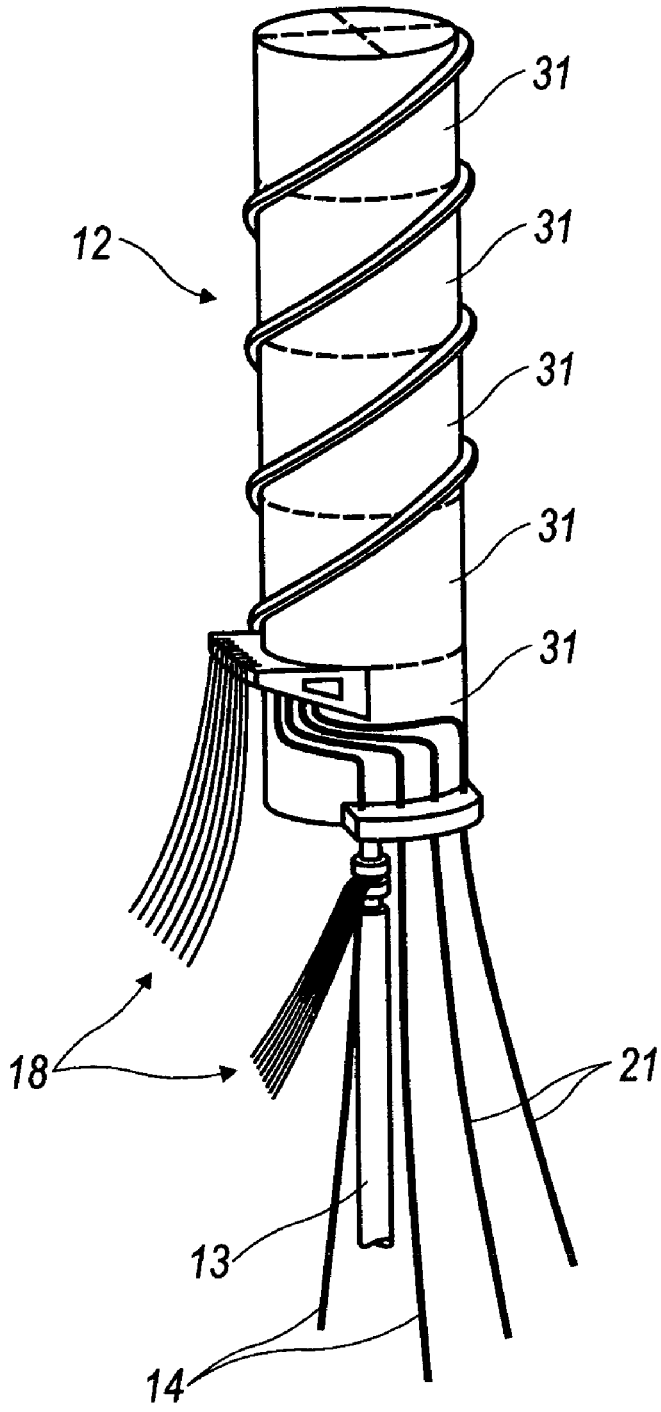
FIG. 3 is an enlargement of a portion of FIG. 1 illustrating a compartmentalized embodiment of the variable buoyancy device and the fluid communication system attached thereto.

FIG. 3 illustrates a close up of an embodiment of the variable buoyancy device 12 of FIG. 2. In this embodiment, the buoyancy of the variable buoyancy device 12 is varied through the controlled flooding and blowing out of the compartments 31 illustrated. The overall buoyancy required to support both the hybrid riser tower 13 and the SCR(s) 14 (and possibly 21) is significantly greater than the overall buoyancy force required to support only a hybrid riser tower. It is necessary to reduce the buoyancy of the variable buoyancy device 12 during installation to prevent exceeding either the mooring limits of mooring 16 or the design tension limit of the hybrid riser tower 13. After the hybrid riser tower 13 is installed, the SCR(s) 14 are attached one at a time. As the SCR(s) 14 are installed, the buoy compartments 31 filled with seawater are blown out to compensate for the additional weight of each SCR(s) 14 as they are attached. After the SCR(s) 14 are secured to the variable buoyancy device 12, flexible jumpers 18 are attached so as to allow fluid communication between the risers terminating at the buoy and the floating production vessel 11. The flexible jumpers 18 are able to withstand the sustained motions and stresses inherent in the wave zone. Alternatively, the installation process can be reversed, whereby the SCR(s) 14 are attached to the variable buoyancy device 12 first, then the hybrid riser tower 13 would be attached, which would require the flooding and subsequent blowing out of fewer compartments 31 of the variable buoyancy device 12.

Figure 4:
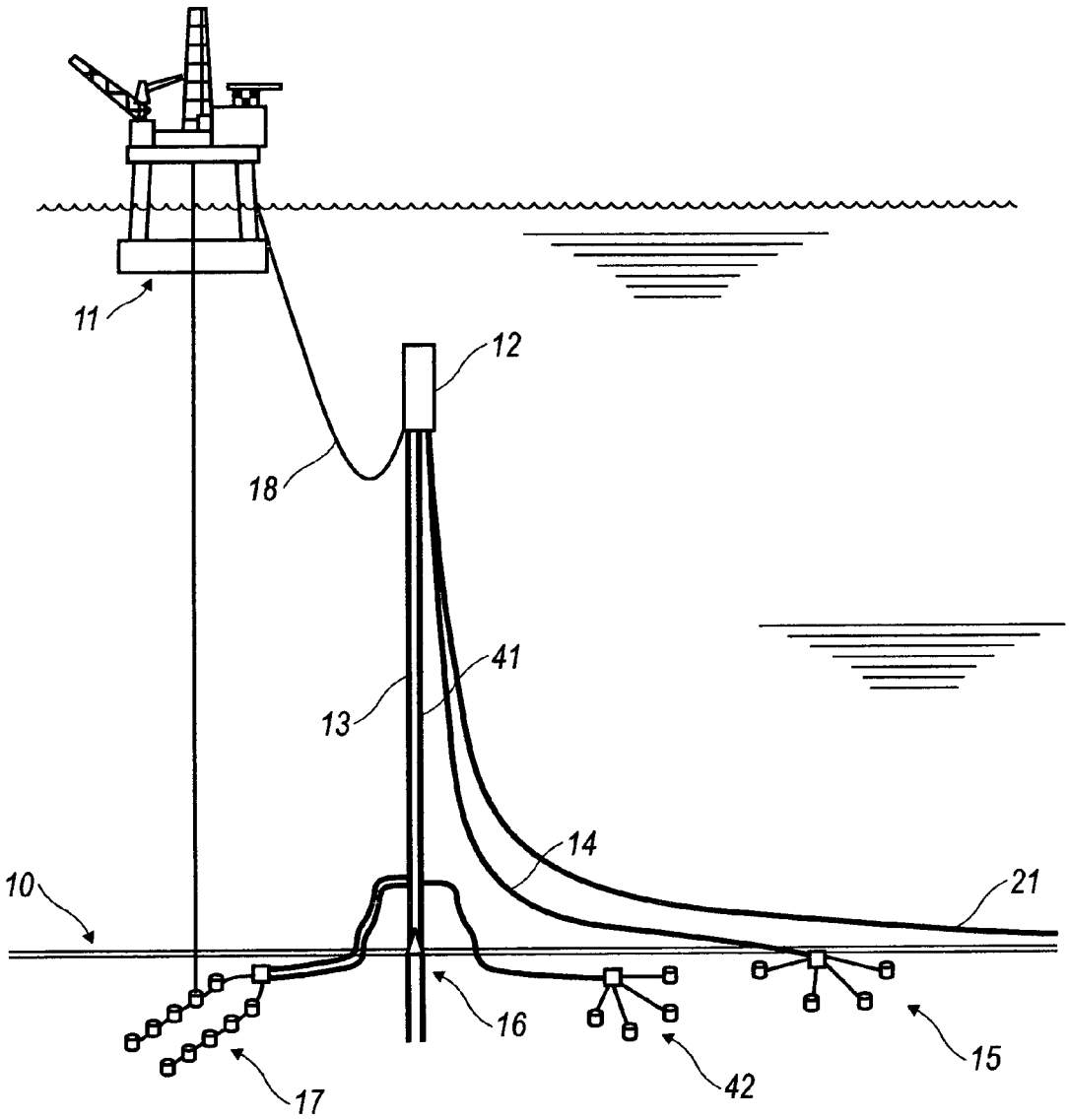
FIG. 4 is an elevation view of another embodiment of the invention where the variable buoyancy device supports an additional hybrid riser tower.

FIG. 4 illustrates another embodiment of the invention useful for either later encountered local production zones 42 or local production requirements in excess of the flow capabilities of the hybrid riser tower 13. The components of this embodiment are the same as in the embodiment illustrated in FIG. 2 except that in this embodiment, a second hybrid riser tower 41 is also attached to and supported by the variable buoyancy device 12. This second hybrid riser tower 41 enables fluid communication between the surface production facility 11 and additional local production zones 42.

Figure 5:
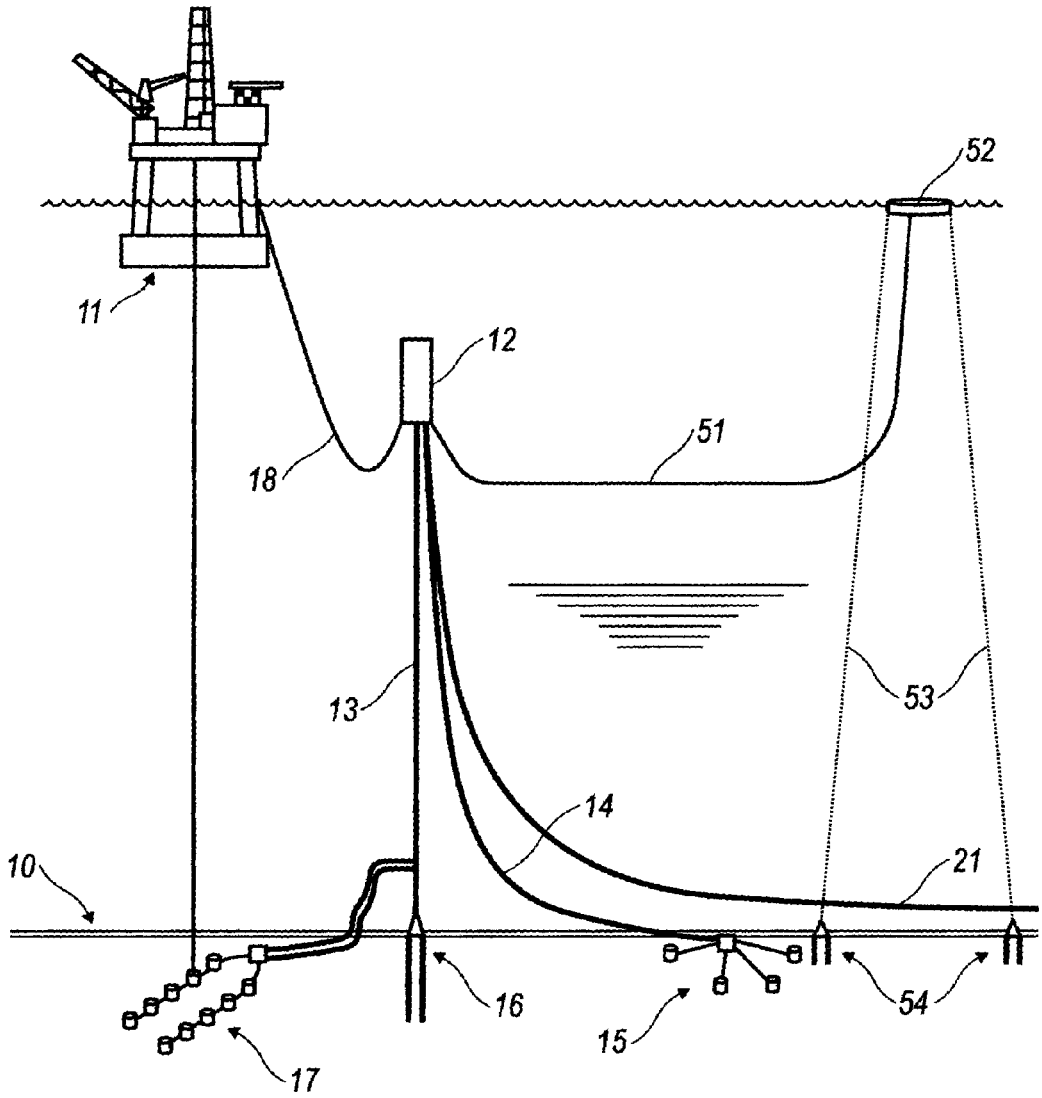
FIG. 5 is an elevation view of another embodiment of the invention where mid-depth transfer lines enable fluid communication to an offloading buoy.

FIG. 5 illustrates another embodiment of the invention useful for enabling the unloading of produced fluids at additional surface locations. The components of this embodiment are the same as in the embodiment illustrated in FIG. 2 except that in this embodiment, a mid-depth transfer line 51 enables fluid communication between the fluid transfer system of the invention and an offloading buoy 52. The offloading buoy 52 is secured to a plurality of anchors 54 by a mooring system 53.

Figure 6:
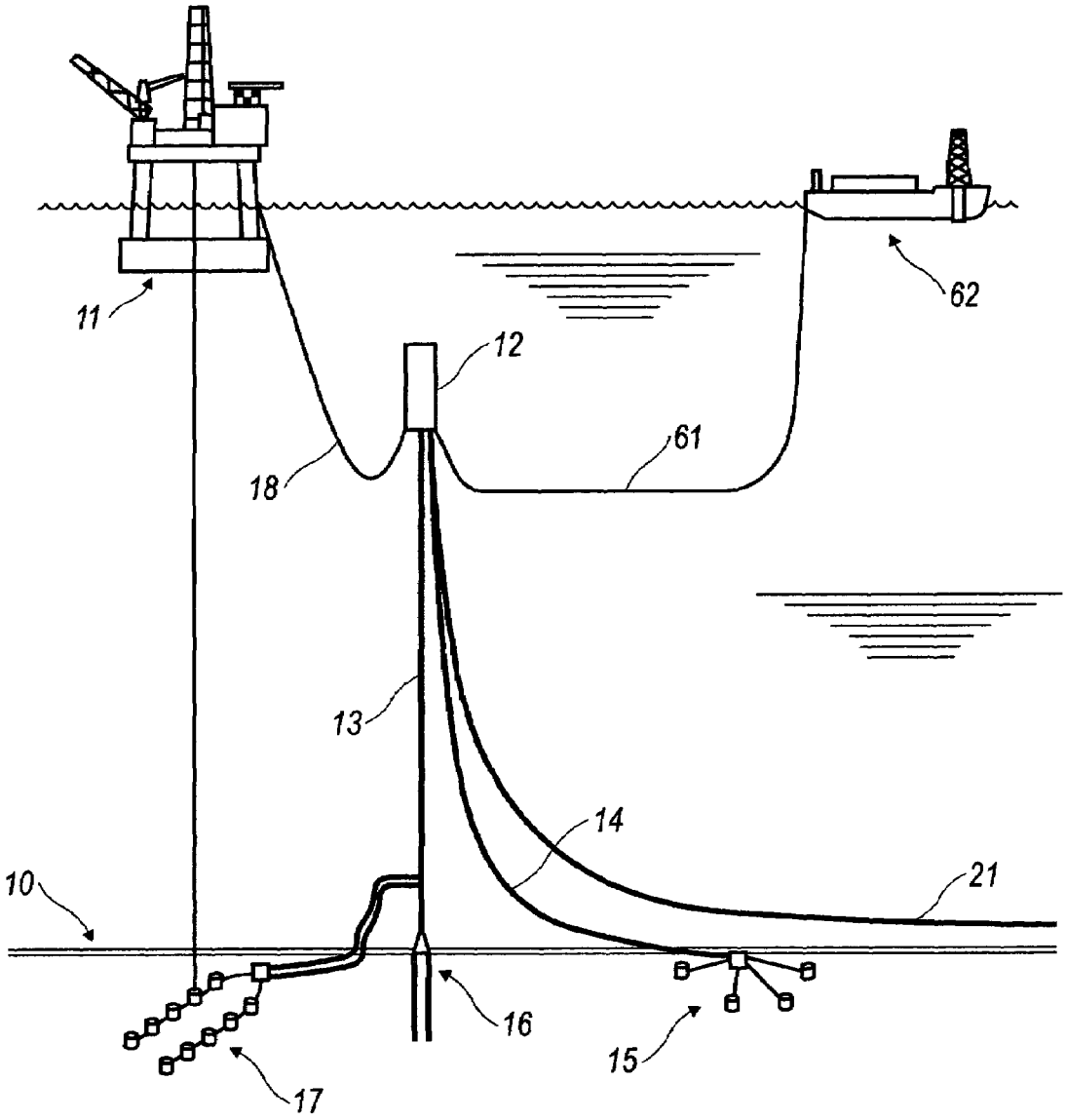
FIG. 6 is an elevation view of another embodiment of the invention where mid-depth transfer lines enable fluid communication to a second surface production facility.

FIG. 6 illustrates another embodiment of the invention useful for enabling unloading of produced fluids to additional surface production facilities. The components of this embodiment are the same as in the embodiment illustrated in FIG. 2 except that in this embodiment, a mid-depth transfer line 61 enables fluid communication between the fluid transfer system of the invention and a second surface production facility 62.

Figure 7:
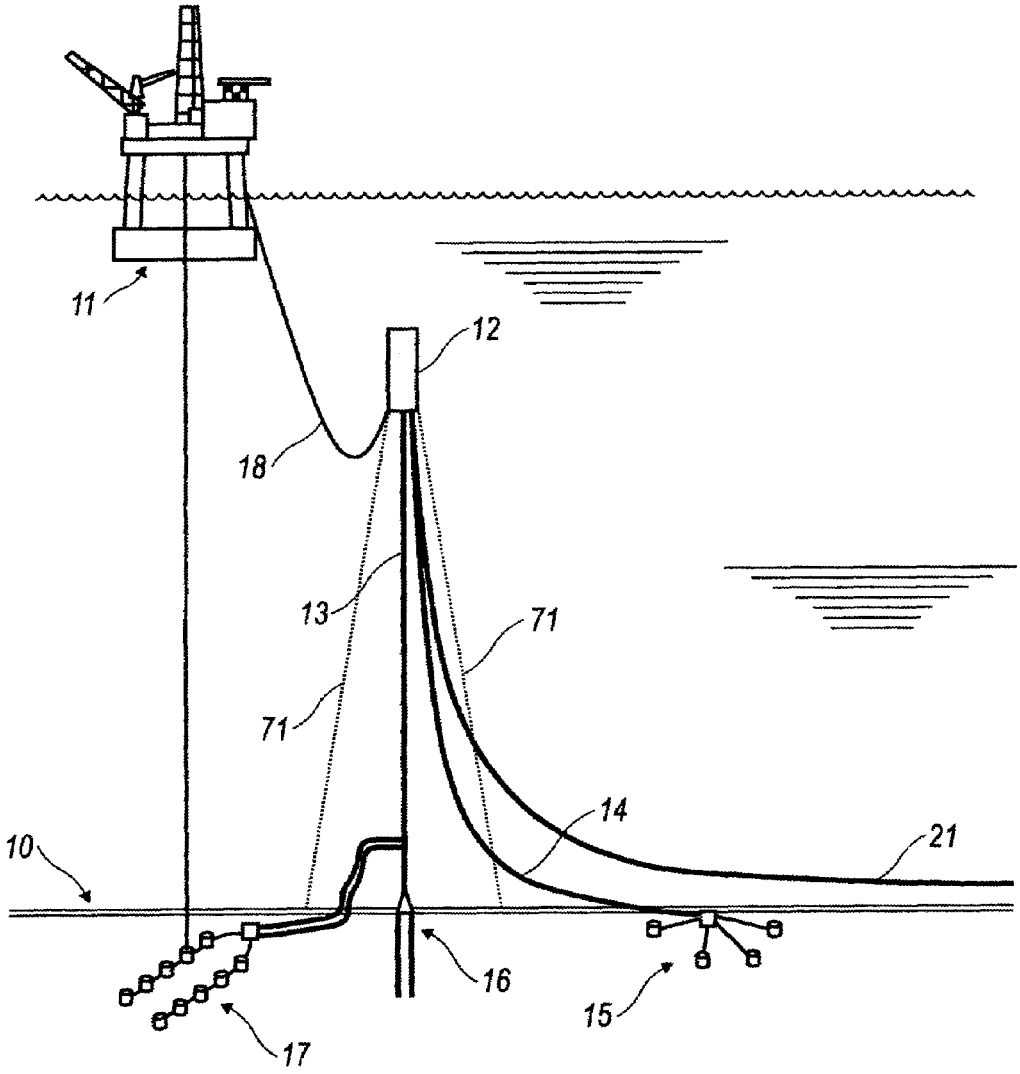
FIG. 7 is an elevation view of another embodiment of the invention where the variable buoyancy device is further secured by mooring lines as shown.

FIG. 7 illustrates another embodiment of the invention with alternate means of ensuring that the design tension limit of the hybrid riser tower 13 is not exceeded. The components of this embodiment are the same as in the embodiment illustrated in FIG. 2 except that in this embodiment, additional mooring lines 71 are installed directly from the variable buoyancy device 12 to the sea floor 10.

Figure 8:
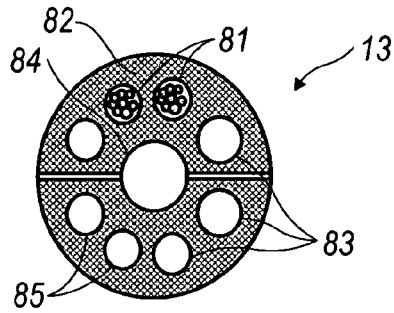
FIG. 8 is a sectional view of an embodiment of the hybrid riser tower of the invention illustrating the elements therein.

FIG. 8 illustrates a cross section of the hybrid riser tower 13. This illustration depicts the various common components of a hybrid riser tower: umbilicals 81, foam insulation 82, production risers 83, injection risers 85, and the carrier pipe structural member 84. In order to increase the design tension limit of the hybrid riser tower, an alternative embodiment of the invention incorporates a strengthened carrier pipe structural member 84 designed to provide a higher tensile strength. In this embodiment, the carrier pipe structural member 84 can be designed to provide a portion of the maximum buoyancy force of the variable buoyancy device 12. This portion can be a fraction of the maximum buoyancy force or it can exceed the maximum buoyancy force depending upon embodiment specific design considerations. The additional tensile strength of the carrier pipe structural member 84 provides a greater safety margin during the installation of the SCR(s), especially during the deballasting of the variable buoyancy device.

Figure 9:
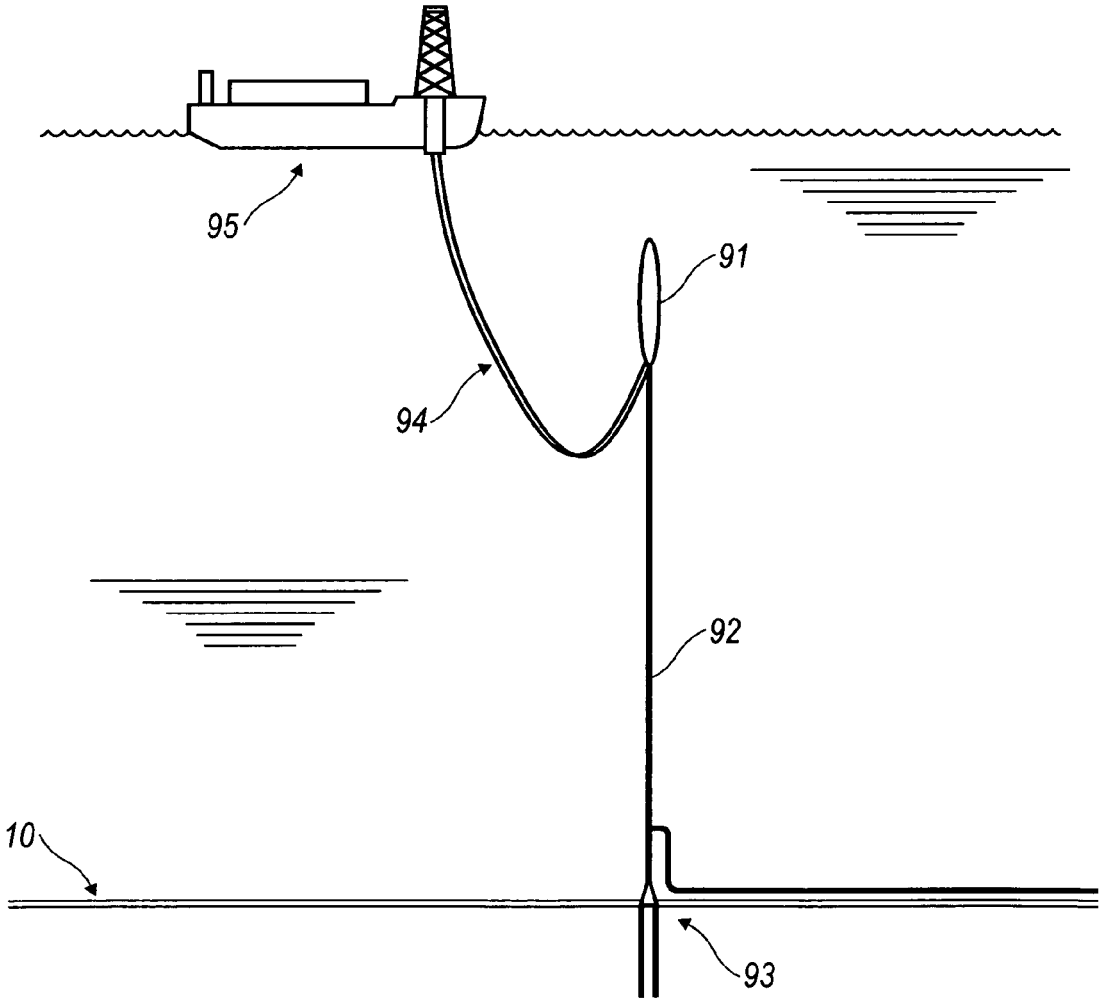
FIG. 9 (PRIOR ART)
FIG. 9 is an elevation view of a prior art hybrid riser tower, shown for illustrative purposes only.

FIG. 9 illustrates an embodiment of a prior art hybrid riser tower, for illustrative purposes only. In this illustration, a surface facility 95 is connected through flexible pipe jumpers 94 to buoy 91 and therefore to hybrid riser tower 92 which is supported by buoy 91 and moored 93 at the sea floor 10.

Figure 10:
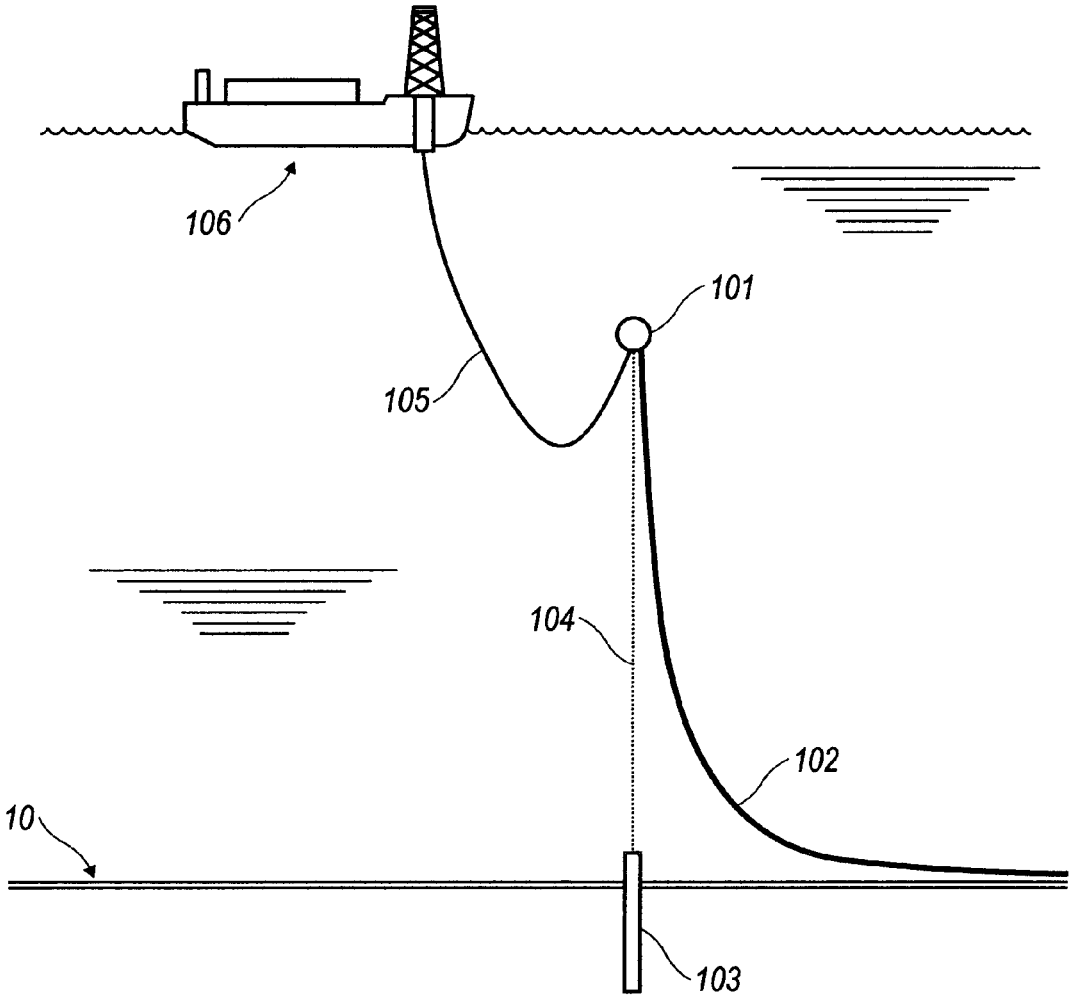
FIG. 10 (PRIOR ART)
FIG. 10 is an elevation view of a prior art steel catenary riser system, shown for illustrative purposes only.

FIG. 10 illustrates an embodiment of a prior art steel catenary riser system, for illustrative purposes only. In this illustration, surface facility 105 is connected through flexible pipe jumpers 105 to buoy 101 and therefore to SCR 102 which is also supported by buoy 101. Mooring chain 104 secures the buoy 101 to a foundation or mooring 103 on the sea floor 10.

The foregoing description has been directed to particular embodiments of the invention for the purpose of illustrating the invention, and is not to be construed as limiting the scope of the invention. It will be apparent to persons skilled in the art that many modifications and variations not specifically mentioned in the foregoing description will be equivalent in function for the purposes of this invention. All such modifications, variations, alternatives, and equivalents are intended to be within the spirit and scope of the present invention, as defined by the appended claims.

What is claimed is:

1. A fluid transfer system for use in offshore hydrocarbon producing operations, comprising:

a hybrid riser tower extending upwardly from the sea floor to a location substantially below the wave zone of the body of water;

a variable buoyancy device having means for varying the buoyancy of said device, to which the upper end of said hybrid riser tower is attached;

one or more steel catenary risers extending upwardly from the sea floor and attached at their upper ends to said variable buoyancy device, wherein the variable buoyancy device is capable of maintaining said hybrid riser tower in a substantially vertical orientation and capable of supporting the one or more steel catenary risers; and one or more flexible pipe jumpers extending from said variable buoyancy device to a surface production facility so as to allow fluid communication between said steel catenary riser terminating at said variable buoyancy device and the surface production facility.

2. The fluid transfer system of claim 1, wherein said surface production facility comprises a floating production facility.

3. The fluid transfer system of claim 1, further comprising mid-depth transfer lines extending from said variable buoyancy device to another surface production facility.

4. The fluid transfer system of claim 1, further comprising mid-depth transfer lines extending from said variable buoyancy device to an offloading buoy.

5. The fluid transfer system of claim 1, wherein said hybrid riser tower includes one or more production risers; one or more umbilicals, a carrier pipe structural member and one or more injection risers.

6. The fluid transfer system of claim 5, wherein said carrier pipe structural member is designed to have sufficient tensile strength to withstand the full buoyancy force of said variable buoyancy device.

7. The fluid transfer system of claim 5, wherein said carrier pipe structural member is designed to have a sufficient tensile strength to withstand a portion of the full buoyancy force of said variable buoyancy device.

8. The fluid transfer system of claim 1, wherein multiple hybrid riser towers are attached to said variable buoyancy device.

9. The fluid transfer system of claim 1, further comprising at least one mooring line connecting the variable buoyancy device to the sea floor.

10. The fluid transfer system of claim 1, wherein said means for varying the buoyancy of said device comprises compartmentalization of said device such that each compartment is configured to be separately flooded and blown out.

11. The fluid transfer system of claim 1, wherein said steel catenary risers extend from said variable buoyancy device to remote production and processing facilities.

12. The fluid transfer system of claim 1, wherein hydrocarbon fluids from one or more subsea wells are transported from the sea floor to said floating production vessel through at least one hybrid riser tower and at least one flexible pipe jumper.

13. The fluid transfer system of claim 1, wherein hydrocarbon fluids are exported from said surface production facility through at least one flexible pipe jumper and at least one steel catenary riser.

14. A process for transferring fluids in offshore hydrocarbon producing operations, comprising the steps of:

installation of a hybrid riser tower, including attaching a variable buoyancy device to the upper end of said hybrid riser tower, where the buoyancy of said variable buoyancy device is first reduced so that its net buoyancy does not exceed the design tension limit of the hybrid riser tower;

installation of one or more steel catenary risers extending upwardly from the sea floor and attached at their upper ends to said variable buoyancy device, where the buoyancy of said variable buoyancy device is increased in order to support said steel catenary risers, while keeping the net buoyancy below the design tension limit of the hybrid riser tower;

attaching the lower ends of a plurality of flexible pipe jumpers to said variable buoyancy device and the upper ends to a surface production facility in such a manner as to allow fluid flow between said risers and said surface production facility.

15. The process of claim 14, further comprising installing mid-depth transfer lines to the variable buoyancy device such as to enable fluid communication to an offloading buoy.

16. The process of claim 14, further comprising installing mid-depth transfer lines to the variable buoyancy device such as to enable fluid communication to an additional surface production facility.

17. The process of claim 14, further comprising installing an additional hybrid riser tower to said variable buoyancy device.

18. The process of claim 14, wherein said variable buoyancy device is compartmentalized such that each compartment can be flooded or blown out independently of the others.

19. The process of claim 14, further comprising installing steel catenary risers from said variable buoyancy device to remote production and processing facilities, such as to enable exportation of fluids to said remote production and processing facilities.

* * * * *